US006657593B2

(12) United States Patent
Nagumo et al.

(10) Patent No.: US 6,657,593 B2
(45) Date of Patent: Dec. 2, 2003

(54) SURFACE MOUNT TYPE ANTENNA AND RADIO TRANSMITTER AND RECEIVER USING THE SAME

(75) Inventors: Shoji Nagumo, Kawasaki (JP); Kengo Onaka, Yokohama (JP); Takashi Ishihara, Machida (JP); Jin Sato, Sagamihara (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 29 days.

(21) Appl. No.: 10/155,118

(22) Filed: May 28, 2002

(65) Prior Publication Data

US 2002/0196192 A1 Dec. 26, 2002

(30) Foreign Application Priority Data

Jun. 20, 2001 (JP) ..... 2001-186886

(51) Int. Cl.[7] ..... H01Q 1/38

(52) U.S. Cl. ..... 343/700 MS; 343/702; 343/770

(58) Field of Search ..... 343/700 MS, 702, 343/767, 770, 846, 848, 873, 893

(56) References Cited

U.S. PATENT DOCUMENTS 5,861,854 A * 1/1999 Kawahata et al. ..... 343/702
5,867,126 A * 2/1999 Kawahata et al. ..... 343/702
5,959,582 A * 9/1999 Kawahata et al. ... 343/700 MS
6,031,503 A * 2/2000 Preiss et al. ..... 343/770
6,100,849 A * 8/2000 Tsubaki et al. ..... 343/702
6,323,811 B1 * 11/2001 Tsubaki et al. ..... 343/700 MS
6,466,176 B1 * 10/2002 Maoz et al. ..... 343/767
6,492,946 B2 * 12/2002 Nagumo et al. ..... 343/700 MS

FOREIGN PATENT DOCUMENTS

JP 09-246849 9/1997 ..... H01Q/13/06

* cited by examiner

*Primary Examiner*—Don Wong
*Assistant Examiner*—Shih Chao Chen
(74) *Attorney, Agent, or Firm*—Keating & Bennett, LLP

(57) ABSTRACT

A surface mount type antenna includes a loop-shaped fed radiation electrode provided on a substrate, and a non-fed radiation electrode is arranged close to the fed radiation electrode with a gap provided therebetween. One end side of the non-fed radiation electrode is grounded, and the other end side is an open end. A signal is sent to the non-fed radiation electrode from the fed radiation electrode by electromagnetic coupling to perform a resonant operation. The fed radiation electrode and the non-fed radiation electrode generate a double-resonant state. The double resonance extends the frequency band. When the fed radiation electrode and the non-fed radiation electrode are provided on the substrate to define an antenna, the size of the antenna is greatly reduced.

18 Claims, 8 Drawing Sheets

SURFACE MOUNT TYPE ANTENNA AND RADIO TRANSMITTER AND RECEIVER USING THE SAME

BACKGROUND OF THE INVENTION

1. Field of the Invention

The present invention relates to surface mount type antennas in which a radiation electrode is provided on a substrate, and radio transmitters and receivers including such surface mount type antennas.

2. Description of the Related Art

FIG. 8A shows an example of a typical antenna. An antenna 30 is disclosed in European Patent Laid-Open No. EP0938158A2, and includes a conductor line 31. One end of the conductor line 31 defines a fed-end section connected to the signal source (transmission and receiving circuit) 32 of a radio transmitter and receiver, such as a portable telephone, and the other end defines an open end. The conductor line 31 is bent in a loop manner, and the open end β of the conductor line 31 is disposed in the vicinity of the fed-end-section side α with a gap therebetween.

The antenna 30 has a return-loss characteristic similar to that shown in FIG. 8B. More specifically, in the antenna 30, the conductor line 31 resonates at resonant frequencies F1 and F2 to execute an antenna operation according to a signal sent from the signal source 32. Among a plurality of resonant frequencies of the conductor line 31, a resonant operation at the lowest resonant frequency is called a basic mode, and a resonant operation at a higher resonant frequency than that of the basic mode is called a high-order mode.

In the antenna 30, the high-order-mode resonant frequency F2 is variably controlled, with the basic-mode resonant frequency F1 being rarely changed when the capacity between the fed-end-section side α and the open end β of the conductor line 31 is variably controlled to variably change the amount of electromagnetic coupling between the fed-end-section side α and the open end β. Therefore, in the antenna 30, the basic-mode resonant frequency F1 and the high-order-mode resonant frequency F2 are easily adjusted to desired frequencies.

Recently, very compact antennas have been demanded for portable telephones and global positioning systems (GPSs). Because the antenna 30 includes the conductor line 31, and the conductor line 31 must have a length corresponding to the specified basic-mode resonant frequency, however, it is difficult to reduce the size of such antennas and it is very difficult to successfully satisfy the recent demand for reducing the size of such antennas.

In addition, since the antenna 30 includes only the conductor line 31, it is difficult to prevent the size of the antenna 30 from increasing while its frequency band is expanded.

SUMMARY OF THE INVENTION

In order to overcome the above-described problems, preferred embodiments of the present invention provide a surface mount type antenna having a reduced size and a wide frequency band, and a radio transmitter and receiver including such a novel antenna.

One preferred embodiment of the present invention provides a surface mount type antenna including a fed radiation electrode to which a signal is sent from a signal source that is provided on a substrate, wherein one or a plurality of fed radiation electrodes each having a loop shape in which a first end defining a fed-end-section which receives a signal from the signal source is disposed opposite the other end which defines an open end, with a gap disposed therebetween is provided, and in addition, a non-fed radiation electrode which is electromagnetically coupled with at least an adjacent fed radiation electrode to generate a double-resonant state is provided on the substrate.

The surface mount type antenna is preferably configured such that the non-fed radiation electrode includes one ground end connected to the ground and another open end, and one or a plurality of non-fed radiation electrodes each having a loop shape in which the open end is disposed opposite a ground-end side with a gap disposed therebetween is formed.

The surface mount type antenna is preferably configured such that the fed radiation electrode and the non-fed radiation electrode perform a basic-mode resonant operation and a high-order-mode resonant operation having a higher resonant frequency than in the basic mode, and the distance between the open end of the loop-shaped fed radiation electrode or the loop-shaped non-fed radiation electrode and a portion opposite the open end through a gap is changed to adjust the capacitance of a capacitor generated between the open end and the portion opposite the open end to that corresponding to a specified high-order-mode resonant frequency.

The surface mount type antenna is preferably configured such that the loop-shaped fed radiation electrode or the loop-shaped non-fed radiation electrode has a loop shape by providing a slit for a plane-shaped pattern, and the slit is folded one or more times, or has a bent shape.

The surface mount type antenna is preferably configured such that the substrate is a dielectric substrate, and the dielectric substrate defines a coupling-amount adjusting element for adjusting the amount of coupling between the fed radiation electrode and the non-fed radiation electrode by the dielectric constant of the substrate.

The surface mount type antenna is preferably configured such that the fed radiation electrode and the non-fed radiation electrode perform a basic-mode resonant operation and a high-order-mode resonant operation having a higher resonant frequency than in the basic mode. The substrate is a dielectric substrate, and the dielectric substrate functions as open-end-capacitor adjusting element for adjusting the capacitance of a capacitor provided between the open end of the loop-shaped fed radiation electrode or the loop-shaped non-fed radiation electrode and a portion opposite the open end by the dielectric constant of the substrate to adjust the high-order-mode resonant frequency.

Additionally, the surface mount type antenna is preferably configured such that one or both of a capacity-loaded electrode disposed through a gap adjacently to the fed radiation electrode and having a capacitor between itself and the fed radiation electrode and a capacity-loaded electrode disposed through a gap adjacently to the non-fed radiation electrode and having a capacitor between itself and the non-fed radiation electrode are provided, and the capacity-loaded electrode(s) is electrically connected to the ground.

Another preferred embodiment of the present invention provides a radio transmitter and receiver including one of the surface mount type antennas according to preferred embodiments described above.

In various preferred embodiments of the present invention, since a surface mount type antenna includes a fed radiation electrode provided on a substrate, the antenna is much more compact than the line-shaped antenna shown in the conventional example. On the substrate, a non-fed radiation electrode is disposed in the vicinity of the fed radiation electrode and is electromagnetically coupled with the fed radiation electrode to generate a double-resonant state. Double resonance caused by the fed radiation electrode and the non-fed radiation electrode can easily extend the frequency band. Therefore, an antenna and a radio transmitter and receiver having a greatly reduced size and a wide frequency band are obtained.

According to preferred embodiments of the present invention, since, on a substrate, a loop-shaped fed radiation electrode is provided and a non-fed radiation electrode is also provided to generate a double-resonant state together with the fed radiation electrode, the antenna is made much more compact than the line-shaped antenna, shown in a conventional example, and the frequency band thereof is easily expanded. Therefore, the surface mount type antenna and the radio transmitter and receiver having a greatly reduced size and an extended frequency band are provided.

When a non-fed radiation electrode has a loop shape, the capacitance of a capacitor defined between an open end and a ground end side of the non-fed radiation electrode is adjusted to easily adjust the high-order-mode resonant frequency without changing the basic-mode resonant frequency, as in a fed radiation electrode. Therefore, the basic-mode and high-order-mode resonant frequencies of the fed radiation electrode and the non-fed radiation electrode are easily adjusted such that, for example, electromagnetic waves can be transmitted and received in frequency bands corresponding to a plurality of communication systems, thus easily implementing a multiple-frequency-band antenna.

Since a fed radiation electrode or a non-fed radiation electrode has a loop shape, its electric field is confined to an area where the fed radiation electrode or the non-fed radiation electrode is provided. Therefore, a narrow frequency band and a reduction in gain caused when the electric field is caught at the ground side are effectively prevented. Such a narrowed frequency band and a reduction in gain are especially likely to occur at a high-order-mode side. The loop-shaped electrode prevents this problem from occurring.

In addition, since the electric field is shut in the area where the fed radiation electrode or the non-fed radiation electrode is formed, the amount of electromagnetic coupling between the fed radiation electrode and the non-fed radiation electrode is easily controlled.

Further, when a plurality of fed radiation electrodes is formed, mutual interference among the plurality of fed radiation electrodes may cause a problem. Because a loop-shaped fed radiation electrode confines an electric field, mutual interference with the loop-shaped fed radiation electrode is suppressed, and the independence of the resonant operation of each fed radiation electrode is greatly increased.

Furthermore, since the electric field is confined, the antenna is unlikely to receive external effects. When a ground object approaches or moves away from the surface mount type antenna, for example, characteristic fluctuations caused by the movement of the object are effectively suppressed.

When a slit is provided in a plane-shaped pattern to form a loop-shaped radiation electrode, the radiation electrode has a larger area than when the loop-shaped radiation electrode is formed by a line-shaped pattern.

When a substrate is a dielectric substrate and it functions as a coupling-amount adjusting element, the adjustment of the distance between a fed radiation electrode and a non-fed radiation electrode, and a change in the dielectric constant of the dielectric substrate adjust the amount of electromagnetic coupling between the fed radiation electrode and the non-fed radiation electrode. Therefore, while the size of the antenna is not increased, the amount of electromagnetic coupling between the fed radiation electrode and the non-fed radiation electrode can be adjusted such that the fed radiation electrode and the non-fed radiation electrode generate a successful double-resonant state, which extends the frequency band.

When the capacitance of a capacitor generated between an open end and a fed-end-section side of a fed radiation electrode is adjusted by the dielectric constant of the dielectric substrate, or when the capacitance of a capacitor formed between an open end and a ground-end-section side of a non-fed radiation electrode is adjusted by the dielectric constant of the dielectric substrate, the high-order-mode resonant frequency of the fed radiation electrode or the non-fed radiation electrode is easily adjusted without changing the shape and size of the fed radiation electrode or the non-fed radiation electrode, that is, without increasing the size of the antenna. In addition, the variable range of the high-order-mode resonant frequency is greatly extended.

When a capacity-loaded electrode to be grounded is arranged in the vicinity of a fed radiation electrode or a non-fed radiation electrode with a capacitor generated therebetween, if the capacitance of the capacitor generated between the fed radiation electrode or the non-fed radiation electrode and the capacity-loaded electrode is variable, the capacitance of a capacitor generated between the fed radiation electrode or the non-fed radiation electrode and the ground is changed to adjust a resonant frequency of the fed radiation electrode and the non-fed radiation electrode. Therefore, the resonant frequency is adjusted much more easily.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

Figure 1A:
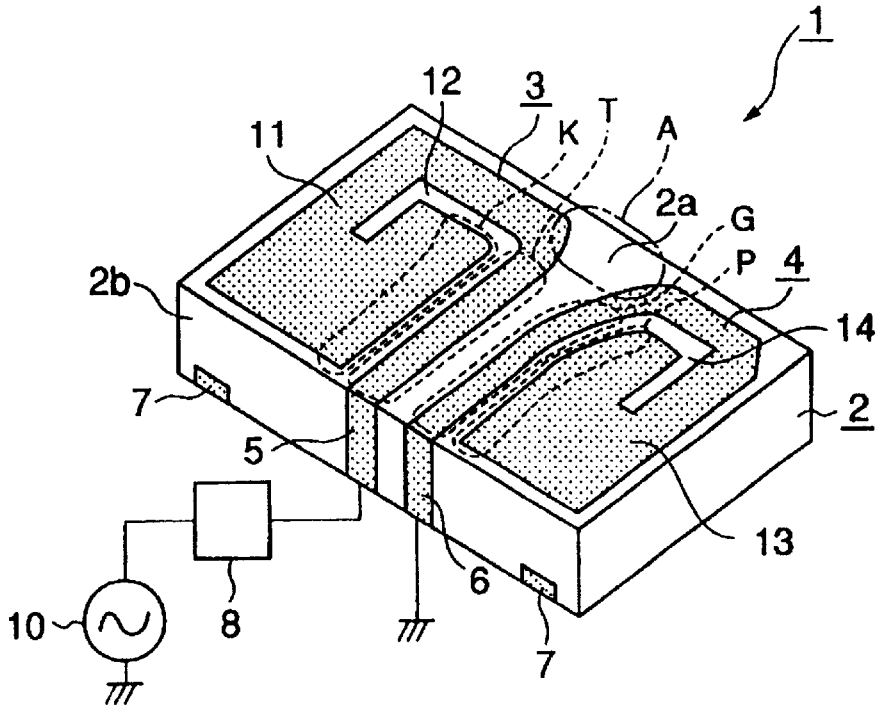
FIG. 1A is a perspective view of a surface mount type antenna according to a first preferred embodiment of the present invention.

Preferred embodiments of the present invention will be described below by referring to the drawings.

FIG. 1A is a perspective view of a characteristic surface mount type antenna in a radio transmitter and receiver according to a first preferred embodiment. Radio transmitters and receivers can have various structures. In the first preferred embodiment, the structure of the radio transmitter and receiver except for the surface mount type antenna may be any suitable structure. A description of the structure of the radio transmitter and receiver except for the surface mount type antenna is thus omitted.

In the first preferred embodiment, the surface mount type antenna 1 includes a substantially rectangular dielectric substrate 2. On an upper surface 2*a* of the dielectric substrate 2, a fed radiation electrode 3 and a non-fed radiation electrode 4 are disposed with a gap provided therebetween. A fed terminal section 5 and a ground terminal section 6 are arranged substantially parallel with a gap provided therebetween on a front end surface 2*b* of the dielectric substrate 2. One end side of the fed terminal section 5 is continuously connected to the fed radiation electrode 3, and the other end side is arranged to extend to a bottom surface of the dielectric substrate 2. One end side of the ground terminal section 6 is continuously connected to the non-fed radiation electrode 4, and the other end side is arranged to extend to the bottom surface of the dielectric substrate 2.

The surface mount type antenna 1 having such a structure is mounted, for example, on a circuit board of the radio transmitter and receiver. In this case, the dielectric substrate 2 is fixed to the circuit board, for example, with solder with its bottom surface facing the circuit board. When the surface mount type antenna 1 is surface-mounted at a specified mounting location on the circuit board, the fed radiation electrode 3 is connected to a signal source (transmission and receiving circuit) 10 of the radio transmitter and receiver, through the fed terminal section 5 and a matching circuit 8 provided in the radio transmitter and receiver. The ground terminal section 6 is grounded. Fixing electrodes 7 are also provided on which solder is provided when the dielectric substrate 2 is soldered to the circuit board, in FIG. 1A.

Figure 2:
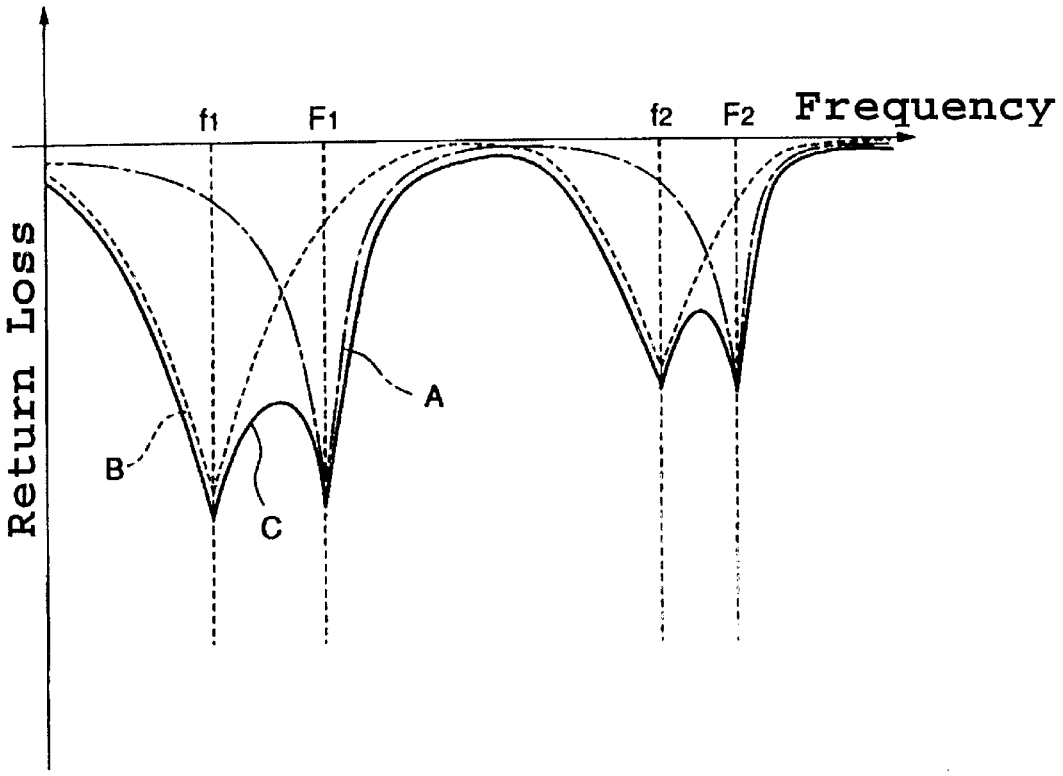
FIG. 2 is a graph showing an example return-loss characteristic of the surface mount type antenna shown in FIG. 1A and FIG. 1B.

The fed radiation electrode 3 has a return-loss characteristic similar to that indicated by a chain line A shown in FIG. 2, and resonates at resonant frequencies F1 and F2 to perform an antenna operation according to a signal sent through the signal source 10 and the matching circuit 8 of the radio transmitter and receiver. In the first preferred embodiment, the fed radiation electrode 3 is configured such that a slit 12 is provided in a plane-shaped pattern 11 on the upper surface 2*a* of the dielectric substrate 2, and an open end K (portion having a strongest electric field) of the fed radiation electrode 3 and its fed-end-section side T continuously connected to the fed terminal section 5 face in opposite directions with a gap provided therebetween.

Therefore, a capacitor is generated between the open end K and the fed-end-section side T of the fed radiation electrode 3. When the capacitance of the capacitor is variable, the high-order-mode resonant frequency F2 of the fed radiation electrode 3 is independently changed without substantially changing the basic-mode resonant frequency F1. The capacitance of the capacitor generated between the open end K and the fed-end-section side T of the fed radiation electrode 3 is adjusted such that the high-order-mode resonant frequency F2 of the fed radiation electrode 3 is adjusted to a specified frequency determined in advance.

The capacitance of the capacitor generated between the open end K and the fed-end-section side T is adjusted by changing the distance between the open end K and the fed-end-section side T or the facing area of the open end K and the fed-end-section side T, and in addition, by changing the dielectric constant $\in_r$ of the dielectric substrate 2 because the fed radiation electrode 3 is provided on the dielectric substrate 2.

When the size of the dielectric substrate 2 is restricted, it is difficult to increase the distance between the open end K and the fed-end-section side T of the fed radiation electrode 3 and the facing area of the open end K and the fed-end-section side T. Therefore, in some cases, the capacitance of the capacitor generated between the open end K and the fed-end-section side T cannot be widely adjusted by the use of the distance between the open end K and the fed-end-section side T or the facing area of the open end K and the fed-end-section side T.

In contrast, the dielectric constant $\in_r$ of the dielectric substrate 2 can be changed irrespective of the restriction of the size. Therefore, the dielectric constant $\in_r$ can be changed to vastly change the capacitance of the capacitor generated between the open end K and the fed-end-section side T. When the compactness of the surface mount type antenna 1 is taken into consideration, the dielectric constant $\in_r$ serves as an important adjustment mechanism for variably adjusting the capacitance of the capacitor generated between the open end K and the fed-end-section side T. In other words, in the first preferred embodiment, the dielectric substrate 2 functions as an open-end-capacitance adjustment element for adjusting the capacitance of the capacitor generated between the open end K and the fed-end-section side T of the fed radiation electrode 3 by varying the dielectric constant $\in_r$ to adjust the high-order-mode resonant frequency F2.

The electrical length of the fed radiation electrode 3 is specified such that the basic-mode resonant frequency is equal to the specified frequency F1 determined in advance.

Figure 1B:
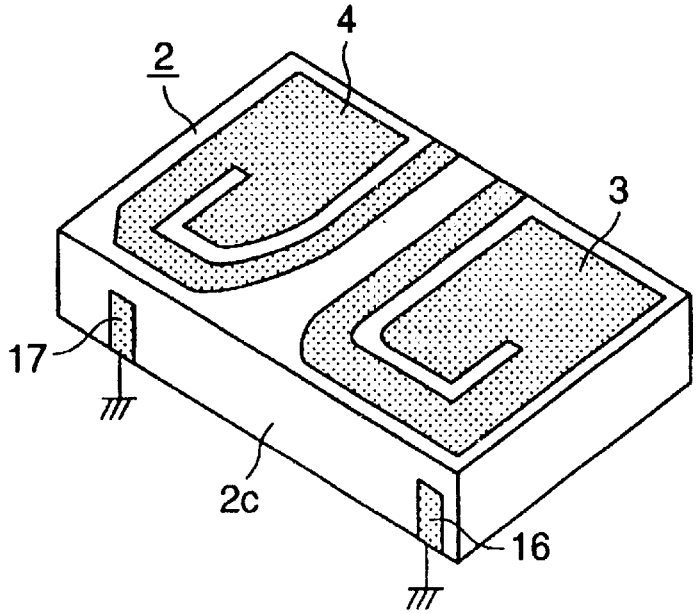
FIG. 1B is another perspective view of the surface mount type antenna shown in FIG. 1A.

In the first preferred embodiment, a capacity-loaded electrode 16 is provided close to the fed radiation electrode 3 on a rear end surface 2*c* of the dielectric substrate 2, as shown in FIG. 1B. The capacity-loaded electrode 16 defines a capacitor with the fed radiation electrode 3, and is grounded. When the capacitance of the capacitor generated between the capacity-loaded electrode 16 and the fed radiation electrode 3 is variable, the capacitance of the capacitor generated between the fed radiation electrode 3 and the ground is changed to change the resonant frequencies F1 and F2 of the fed radiation electrode 3. In the first preferred embodiment, the adjustment of the capacitance of the capacitor defined between the capacity-loaded electrode 16 and the fed radiation electrode 3 also adjusts the resonant frequencies F1 and F2 of the fed radiation electrode 3.

The non-fed radiation electrode 4 is arranged close to the fed radiation electrode 3 with a gap provided therebetween. The fed radiation electrode 3 sends a signal to the non-fed radiation electrode 4 by electromagnetic coupling. The non-fed radiation electrode 4 has a return-loss characteristic as indicated by a dotted line B in FIG. 2, and resonates at resonant frequencies f1 and f2 with a signal sent from the fed radiation electrode 3 to perform an antenna operation. In the first preferred embodiment, the basic-mode resonant frequency f1 of the non-fed radiation electrode 4 is adjusted to be in the vicinity of the basic-mode resonant frequency F1 of the fed radiation electrode 3. The high-order-mode resonant frequency f2 of the non-fed radiation electrode 4 is also adjusted to be in the vicinity of the high-order-mode resonant frequency F2 of the fed radiation electrode 3.

In the first preferred embodiment, in the same manner as for the fed radiation electrode 3, the non-fed radiation electrode 4 includes a slit 14 that is provided in a plane-shaped pattern 13 on the upper surface 2*a* of the dielectric substrate 2 and an open end P of the non-fed radiation electrode 4 and its ground-end side G continuously connected to the ground terminal section 6 face in opposite directions with a gap provided therebetween. Therefore, in the non-fed radiation electrode 4, the capacitance of a capacitor generated between the open end P and the ground-terminal side G is adjusted to set the high-order-mode resonant frequency f2 to a specified frequency, in the same manner as for the fed radiation electrode 3. In other words, in the first preferred embodiment, the dielectric substrate 2 functions as an open-end-capacitance adjustment element at a non-fed side. The basic-mode resonant frequency f1 of the non-fed radiation electrode 4 is adjusted by the electrical length.

Also in the vicinity of the non-fed radiation electrode 4, a capacity-loaded electrode 17 which defines a capacitor with the non-fed radiation electrode 4 is provided. The capacity-loaded electrode 17 is provided on the rear end surface 2*c* of the dielectric substrate 2, and is grounded. In the same manner as for the capacity-loaded electrode 16 provided in the vicinity of the fed radiation electrode 3, when the capacitance of the capacitor generated between the capacity-loaded electrode 17 and the non-fed radiation electrode 4 is variable, the capacitance of the capacitor formed between the non-fed radiation electrode 4 and the ground is changed to adjust the resonant frequencies f1 and f2 of the non-fed radiation electrode 4.

In the first preferred embodiment, the non-fed radiation electrode 4 and the fed radiation electrode 3 have the above-described return-loss characteristics, and double-resonant states occur at the basic-mode side and the high-order-mode side. The surface mount type antenna 1 has a return-loss characteristic indicated by a solid line C in FIG. 2.

If the amount of electromagnetic coupling between the non-fed radiation electrode 4 and the fed radiation electrode 3 is excessive, unsuitable conditions occur, such as the attenuation of the resonance of the non-fed radiation electrode 4, such that a successful double-resonance state cannot be achieved. With this taken into consideration, in the first preferred embodiment, the amount of electromagnetic coupling between the fed radiation electrode 3 and the non-fed radiation electrode 4 is adjusted such that the fed radiation electrode 3 and the non-fed radiation electrode 4 are electromagnetically coupled with a suitable amount of electromagnetic coupling to generate successful double-resonant states as shown in FIG. 2. There are various methods for adjusting the amount of electromagnetic coupling. In one example method, among the distances between the fed radiation electrode 3 and the non-fed radiation electrode 4, the distance of a portion A having a strong electric field (shown in FIG. 1A) is made variable to adjust the amount of electromagnetic coupling. There is another method in which the amount of electromagnetic coupling between the fed radiation electrode 3 and the non-fed radiation electrode 4 is adjusted by the dielectric constant $\in_r$ of the dielectric substrate 2. In this method, the dielectric substrate 2 functions as a coupling-amount adjusting element for adjusting the amount of electromagnetic coupling between the fed radiation electrode 3 and the non-fed radiation electrode 4.

According to the first preferred embodiment, since the fed radiation electrode 3 and the non-fed radiation electrode 4 are arranged on the dielectric substrate 2 to define an antenna, the antenna is much more compact than the line-shaped antenna 30, shown in a conventional example. In addition, since the non-fed radiation electrode 4 is arranged in the vicinity of the fed radiation electrode 3, and double-resonant states are generated by the fed radiation electrode 3 and the non-fed radiation electrode 4 in the first preferred embodiment, the frequency band is easily expanded. Therefore, the surface mount type antenna 1 and the radio transmitter and receiver which easily provide compactness and an extended frequency band are provided.

Further, in the first preferred embodiment, since the fed radiation electrode 3 and the non-fed radiation electrode 4 are arranged in loop shapes, and capacitors are defined between the open end K and the fed-end-section side T and between the open end P and the ground end side G, the capacitances of the capacitors are adjusted to variably change the high-order-mode resonant frequencies F2 and f2 independently of the basic-mode resonant frequencies F1 and f2. Therefore, the resonant frequencies of the fed radiation electrode 3 and the non-fed radiation electrode 4 are easily adjusted.

Still further, in the first preferred embodiment, since the fed radiation electrode 3 and the non-fed radiation electrode 4 are provided on the dielectric substrate 2, when the dielectric constant $\in_r$ of the dielectric substrate 2 is changed, the capacitance of the capacitor defined between the open end K and the fed-end-section side T of the fed radiation electrode 3, and the capacitance of the capacitor defined between the open end P and the ground end side G of the non-fed radiation electrode 4 are vastly changed. Therefore, the high-order-mode resonant frequencies F2 and f2 of the fed radiation electrode 3 and the non-fed radiation electrode 4 are adjusted in a wide range without substantially changing the shapes and sizes of the fed radiation electrode 3 and the non-fed radiation electrode 4, that is, without increasing the size thereof. Consequently, the surface mount type antenna 1 can be designed more flexibly.

As described above, the resonant frequencies are easily adjusted, and in addition, the distance between the fed radiation electrode 3 and the non-fed radiation electrode 4 or the dielectric constant $\in_r$ of the dielectric substrate 2 are adjusted to appropriately adjust the amount of electromagnetic coupling between the fed radiation electrode 3 and the non-fed radiation electrode 4. Therefore, compactness is achieved and multiple frequency bands, including dual bands, are also provided.

In the first preferred embodiment, the fed radiation electrode 3 and the non-fed radiation electrode 4 are arranged in loop shapes. Therefore, electric fields are confined to areas where the fed radiation electrode 3 and the non-fed radiation electrode 4 are provided. A narrowed frequency band and a reduction in gain caused when the electric fields are trapped at the ground side are prevented. This advantage is especially important in the high-order mode.

Since the electric fields are confined, the amount of electromagnetic coupling between the fed radiation electrode 3 and the non-fed radiation electrode 4 is easily controlled.

When a ground object approaches or moves away from the surface mount type antenna 1, for example, if the electric fields are weakly confined, the antenna gain fluctuates according to the movement of the ground object. In contrast, in the first preferred embodiment, since the fed radiation electrode 3 and the non-fed radiation electrode 4 are arranged in loop shapes, such that the electric fields are strongly confined, characteristic fluctuation caused by the relative movement of an object against the surface mount type antenna 1 is effectively suppressed. Since the fed radiation electrode 3 and the non-fed radiation electrode 4 are arranged in loop shapes in the first preferred embodiment, the surface mount type antenna 1 and the radio transmitter and receiver which are unlikely to be affected by the surrounding environment and which provide stable electromagnetic-wave transmission and receiving are provided.

A second preferred embodiment will be described next. In the description of the second preferred embodiment, the same symbols as those used in the first preferred embodiment are assigned to the same portions as those shown in the first preferred embodiment, and a description of the same portions is omitted.

Figure 3A:
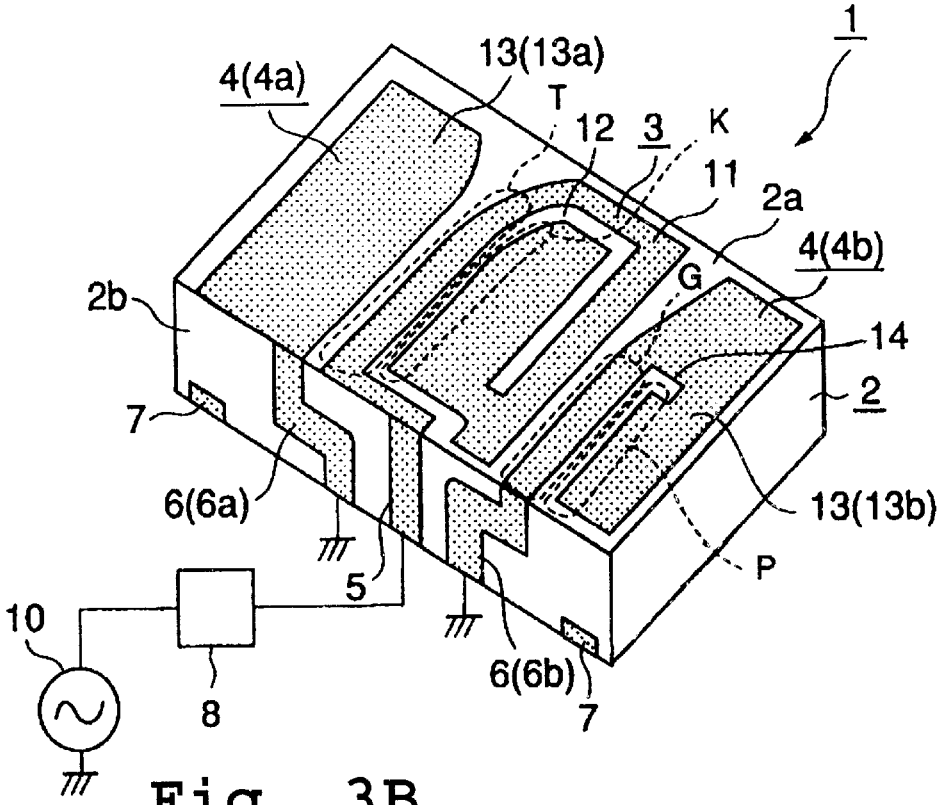
FIG. 3A is a perspective view of a surface mount type antenna according to a second preferred embodiment of the present invention.

In the second preferred embodiment, as shown in FIG. 3A, a plurality of non-fed radiation electrodes 4 (4*a* and 4*b*) is provided. The other portions include similar elements as in the first preferred embodiment, and thus, repetitious description of such portions will be omitted.

In the second preferred embodiment, the plurality of non-fed radiation electrodes 4*a* and 4*b* is disposed so as to sandwich a fed radiation electrode 3 with gaps provided, and one non-fed radiation electrode (4*b*) is arranged in a loop shape.

Figure 3B:
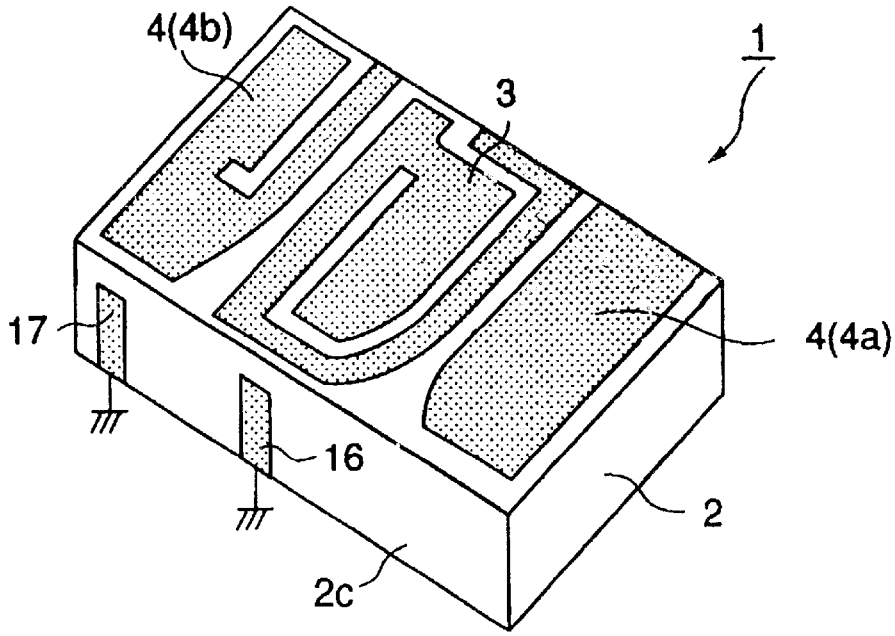
FIG. 3B is another perspective view of the surface mount type antenna shown in FIG. 3A.

Also in the second preferred embodiment, as shown in FIG. 3B, on a rear end surface 2*c* of a dielectric substrate 2, a grounded capacity-loaded electrode 16 and a capacitor defined between itself and the fed radiation electrode 3 is provided, and a grounded capacity-loaded electrode 17 and a capacitor defined between itself and the non-fed radiation electrode 4*b* is provided, in the same manner as in the first preferred embodiment. A grounded capacity-loaded electrode 17 and a capacitor defined between itself and the non-fed radiation electrode 4*a* is provided.

Figure 4:
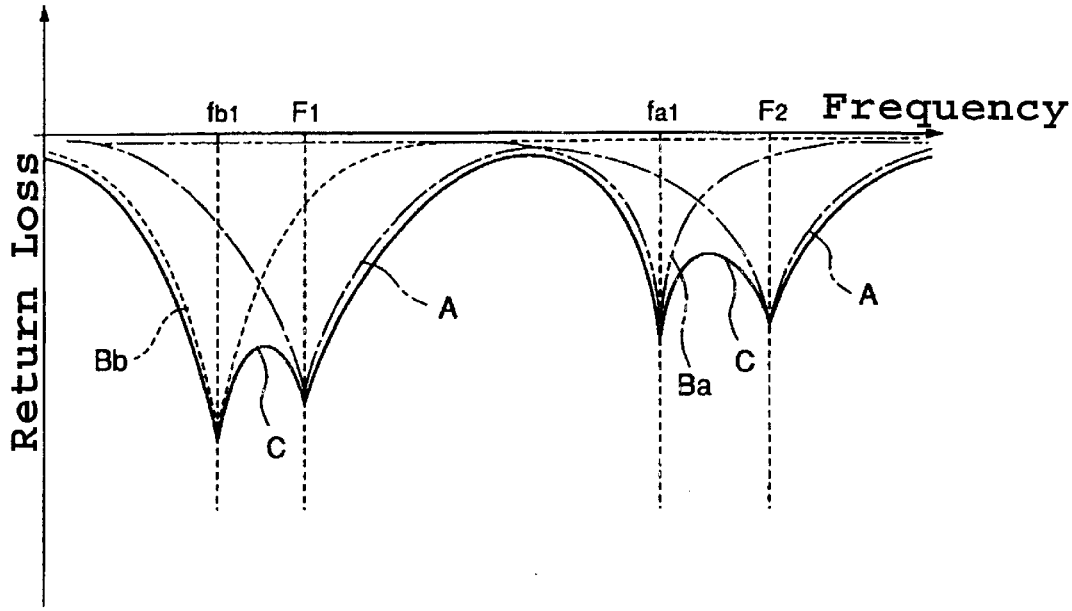
FIG. 4 is a graph showing an example return-loss characteristic of the surface mount type antenna shown in FIG. 3A and FIG. 3B.

In the second preferred embodiment, the electrical length of the fed radiation electrode 3, the capacitance of a capacitor defined between an open end K and a fed-end-section side T of the fed radiation electrode 3, and the capacitance of the capacitor defined between the fed radiation electrode 3 and the capacity-loaded electrode 16 are, for example, adjusted, such that the fed radiation electrode 3 has a return-loss characteristic indicated by a one-dot chain line A in FIG. 4.

In the second preferred embodiment, the non-fed radiation electrode 4*a* has a return-loss characteristic indicated by a two-dot chain line Ba in FIG. 4, and the basic-mode resonant frequency fa1 of the non-fed radiation electrode 4 is similar to the high-order-mode resonant frequency F2 of the fed radiation electrode 3. The non-fed radiation electrode 4*b*, having a loop shape, has a return-loss characteristic indicated by a dotted line Bb in FIG. 4, and the basic-mode resonant frequency fb1 of the non-fed radiation electrode 4 is similar to the basic-mode resonant frequency F1 of the fed radiation electrode 3.

The amount of electromagnetic coupling between the non-fed radiation electrode 4*a* and the fed radiation electrode 3, and the amount of electromagnetic coupling between the non-fed radiation electrode 4*b* and the fed radiation electrode 3 are adjusted by adjusting the dielectric constant $\in_r$ of the dielectric substrate 2, the distance between the radiation electrodes 3 and 4, and other factors such that these non-fed radiation electrodes 4*a* and 4*b* and the fed radiation electrode 3 are electromagnetically coupled to produce a double-resonant states. With these adjustments, the basic mode of the fed radiation electrode 3 and the basic mode of the non-fed radiation electrode 4*b* define a double-resonant state, and the high-order mode of the fed radiation electrode 3 and the high-order mode of the non-fed radiation electrode 4*a* define a double-resonant state. The surface mount type antenna 1 according to the second preferred embodiment has a return-loss characteristic indicated by a solid line C in FIG. 4.

Also in the second preferred embodiment, the same advantages as in the first preferred embodiment are obtained. Especially in the second preferred embodiment, since the plurality of non-fed radiation electrode 4 is provided, it is easier to implement multiple frequency bands.

A third preferred embodiment will be described next. In the description of the third preferred embodiment, the same symbols as those used in each of the above-described preferred embodiments are assigned to the same portions as those shown in each of the preferred embodiments, and a description of the same portions is omitted.

Figure 5:
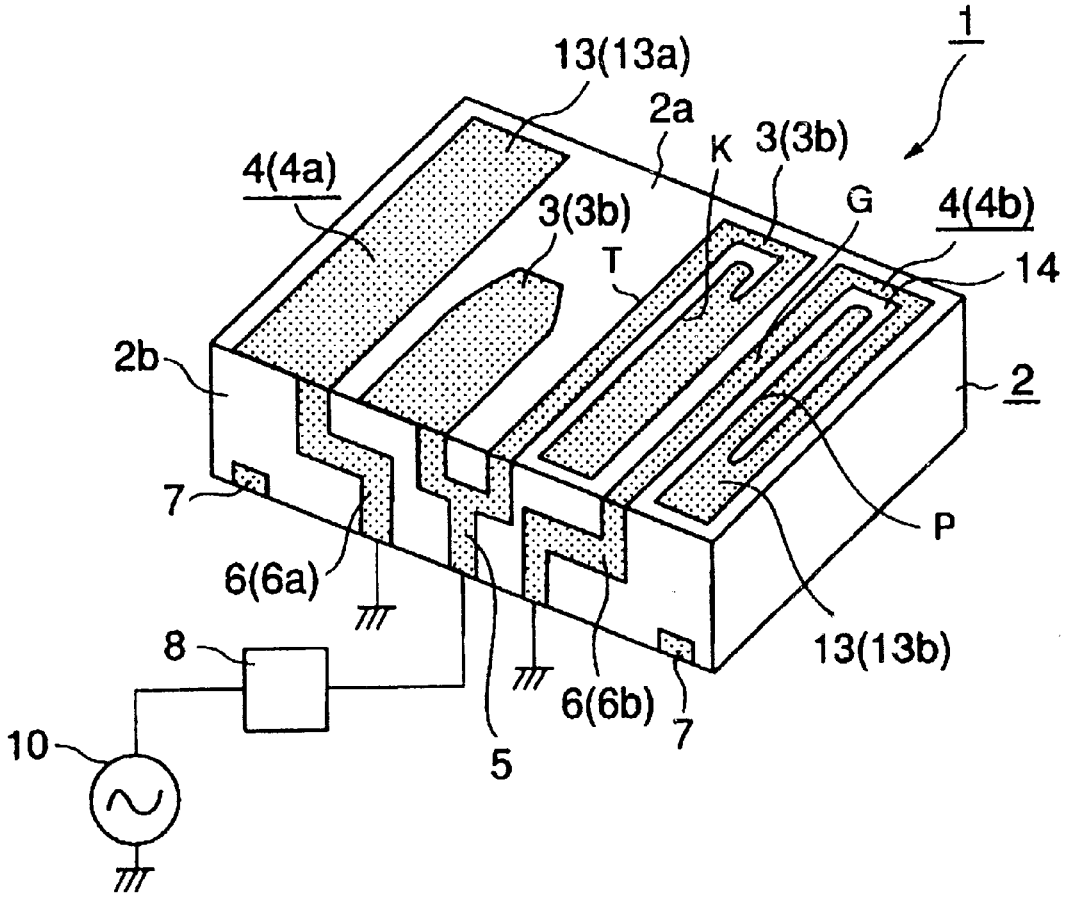
FIG. 5 is a perspective view of a surface mount type antenna according to a third preferred embodiment of the present invention.

In the third preferred embodiment, as shown in FIG. 5, a plurality of fed radiation electrodes 3 (3*a* and 3*b*) is provided on a dielectric substrate 2. The other portions have almost the same structure as in the second preferred embodiment.

In the third preferred embodiment, the plurality of fed radiation electrodes 3*a* and 3*b* is arranged substantially parallel to a gap provided therebetween, and one (a fed radiation electrode 3*b*) of the fed radiation electrodes 3*a* and 3*b* is arranged in a loop shape. Non-fed radiation electrodes 4*a* and 4*b* are arranged to sandwich the fed radiation electrodes 3*a* and 3*b* with gaps provided therebetween.

A fed terminal section 5 branches into two paths at a fed radiation electrode 3 side and is continuously connected to the fed radiation electrodes 3*a* and 3*b*. The fed radiation electrodes 3*a* and 3*b* are connected to a signal source 10 through a matching circuit 8 in a radio transmitter and receiver, through the common fed terminal section 5.

Figure 6:
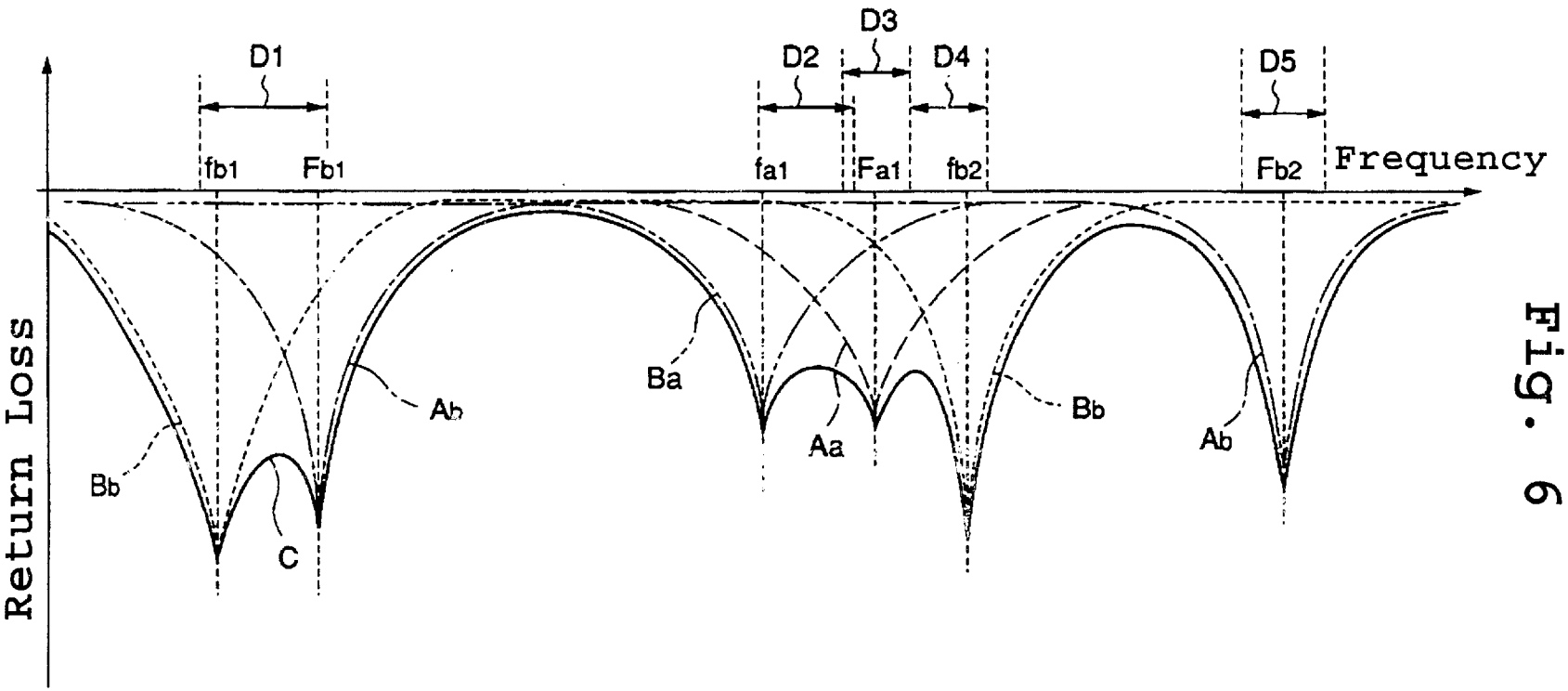
FIG. 6 is a graph showing an example return-loss characteristic of the surface mount type antenna shown in FIG. 5.

In the third preferred embodiment, the fed radiation electrode 3*a* has a return-loss characteristic as indicated by a dash line Aa in FIG. 6, and its basic-mode resonant frequency is adjusted to a frequency Fa1. The loop-shaped fed radiation electrode 3*b* has a return-loss characteristic as indicated by a one-dot chain line Ab in FIG. 6, its basic-mode resonant frequency is adjusted to a frequency Fb1, and its high-order-mode resonant frequency is adjusted to a frequency Fb2. The non-fed radiation electrode 4*a* has a return-loss characteristic as indicated by a two-dot chain line Ba, and its basic-mode resonant frequency is adjusted to a frequency fa1. The loop-shaped non-fed radiation electrode 4*b* has a return-loss characteristic as indicated by a dotted line Bb, its basic-mode resonant frequency is adjusted to a frequency fb1, and its high-order-mode resonant frequency is adjusted to a frequency fb2.

Also in the third preferred embodiment, in the same manner as in the first and second preferred embodiments, the amount of electromagnetic coupling between the fed radiation electrode 3 and the non-fed radiation electrode 4 is adjusted such that the fed radiation electrodes 3 (3*a* and 3*b*) and the non-fed radiation electrodes 4 (4*a* and 4*b*) generate successful double-resonant states. With this adjustment, the surface mount type antenna 1 has a return-loss characteristic as indicated by a solid line C in FIG. 6.

Also in the third preferred embodiment, the same advantages as in the above-described preferred embodiments are obtained. In addition, since the plurality of fed radiation electrodes 3 is provided, it is easier to provide multiple frequency bands. When the resonant frequencies of the fed radiation electrodes 3 and the non-fed radiation electrodes 4 are set such that a frequency range D1 shown in FIG. 6 corresponds to a global system for mobile communication (GSM), a frequency range D2 corresponds to a digital cellular system (DCS), a frequency range D3 corresponds to a personal communication system (PCS), a frequency range D4 corresponds to wideband-code division multiple access (W-CDMA), and a frequency band D5 corresponds to Bluetooth, for example, five communication systems are accommodated.

Since the plurality of fed radiation electrodes 3 is provided in the third preferred embodiment, mutual interference between the fed radiation electrodes 3*a* and 3*b* may cause a problem. Because one of the fed radiation electrodes 3*a* and 3*b* has a loop shape, the loop-shaped fed radiation electrode 3 (3*b*) confines an electric field to suppress mutual interference between the fed radiation electrodes 3*a* and 3*b*.

In the third preferred embodiment, in the same manner as in the above-described preferred embodiments, on a rear end surface 2*c* of a dielectric substrate 2, a capacity-loaded electrode 16 having a capacitor between itself and a fed radiation electrode 3 and a capacity-loaded electrode 17 having a capacitor between itself and a non-fed radiation electrode 4 are provided. These capacity-loaded electrodes 16 and 17 are not necessarily required when the resonant frequencies of the fed radiation electrodes 3 and the non-fed radiation electrodes 4 can be adjusted without the capacity-loaded electrodes.

Figure 7A:
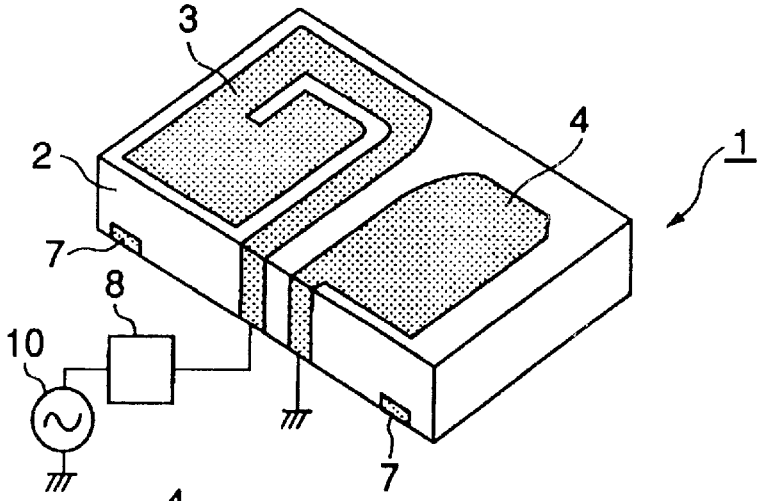
FIGS. 7A, 7B, and 7C are views showing surface mount type antennas according to other preferred embodiments of the present invention.

The present invention is not limited to the above-described preferred embodiments, and can be applied to various other embodiments. When the high-order mode of a non-fed radiation electrode 4 is not used, for example, the high-order-mode resonant frequency f2 of the non-fed radiation electrode 4 need not be controlled. In such a case, the non-fed radiation electrode 4 does not have a loop shape as shown, for example, in FIG. 7A.

In the second and third preferred embodiments, only one of the non-fed radiation electrodes 4*a* and 4*b* has a loop shape. Both electrodes may have loop shapes. In the third preferred embodiment, only one of the fed radiation electrodes 3*a* and 3*b* has a loop shape. Both electrodes may have loop shapes. Three or more fed radiation electrodes 3 or three or more non-fed radiation electrodes 4 may be provided. The number of fed radiation electrodes 3 or that of non-fed radiation electrodes is not limited to the preferred embodiments described above.

In the first and second preferred embodiments, the capacity-loaded electrodes 16 and 17 are provided. These capacity-loaded electrodes 16 and 17 may be omitted if the resonant frequencies of the fed radiation electrodes 3 and the non-fed radiation electrodes 4 are easily adjusted without the capacity-loaded electrodes.

Figure 7B:
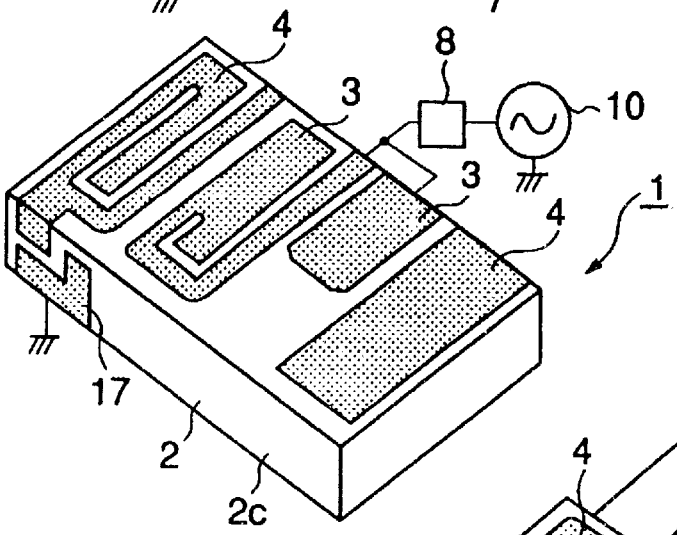

When the capacitance of the capacitor defined between the capacity-loaded electrode 16 and the fed radiation electrodes 3, or the capacitance of the capacitor defined between the capacity-loaded electrode 17 and the non-fed radiation electrodes 4 is greater than that in each of the above-described preferred embodiments, a surface mount type antenna 1 may be configured as shown, for example, in FIG. 7B. In this case, the capacity-loaded electrode 17 has a greater width than in each of the above-described preferred embodiments, and a portion of a non-fed radiation electrode 4 extends toward the capacity-loaded electrode 17 such that the opposing areas of the capacity-loaded electrode 17 and the non-fed radiation electrode 4 are increased.

Figure 7C:
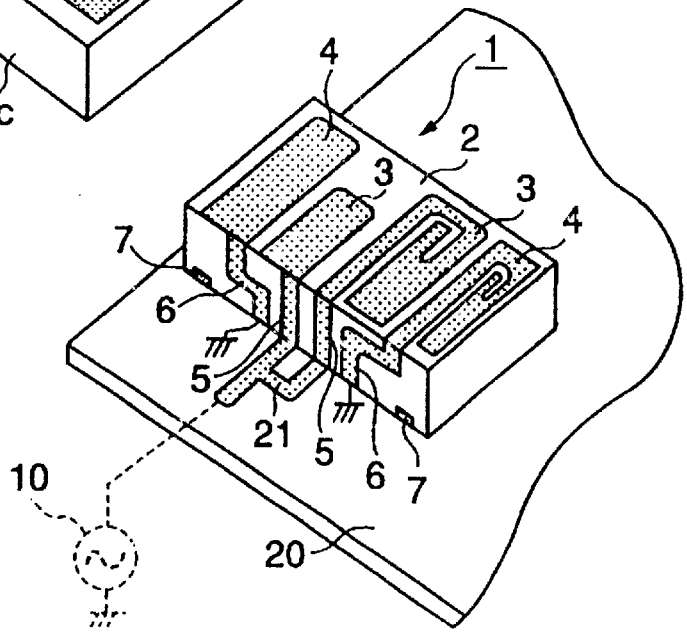
Figure 8A:
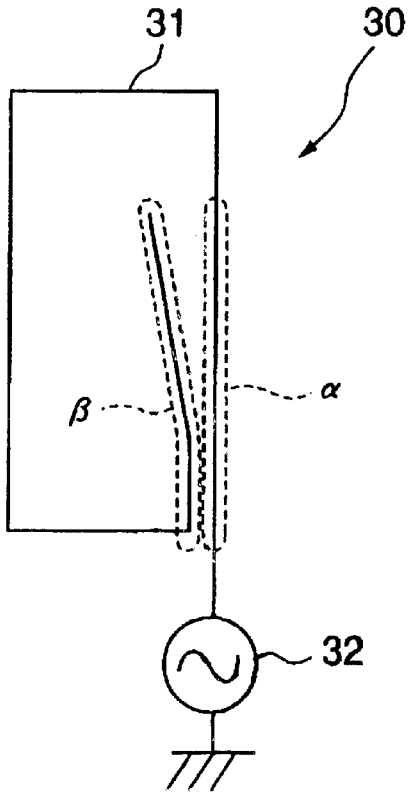
Fig. 8A PRIOR ART
FIG. 8A is a view showing a conventional antenna.
Figure 8B:
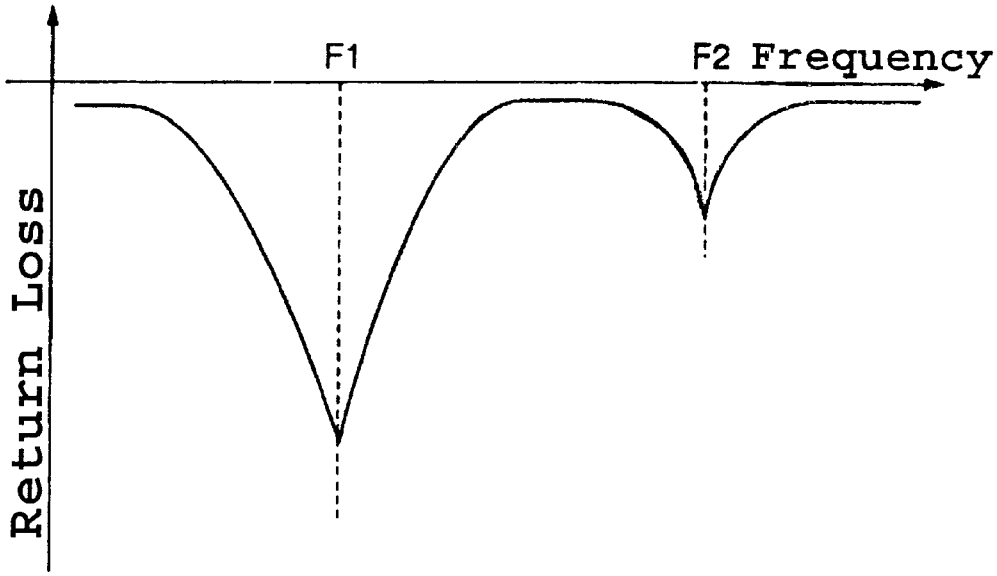
Fig. 8B PRIOR ART
FIG. 8B is a graph showing the return-loss characteristic of the conventional antenna shown in FIG. 8A.

In the third preferred embodiment, the fed terminal section 5 branches into two paths at the fed radiation electrode 3 side, and the plurality of fed radiation electrodes 3 is connected to the signal source 10 through the common fed terminal section 5. When a feeding pattern 21 for connecting the plurality of fed radiation electrodes 3 to the signal source 10 is provided, for example, on a circuit board 20 on which the surface mount type antenna 1 is surface-mounted, as shown, for example, in FIG. 7C, fed terminal sections 5 used only for the fed radiation electrodes 3 may be provided on the dielectric substrate 2.

The resonant frequencies of the fed radiation electrode 3 and the non-fed radiation electrode 4 may be specified appropriately. They are not limited to those shown in FIG. 2, FIG. 4, and FIG. 6.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A surface mount type antenna comprising:

a substrate;

at least one fed radiation electrode arranged to receive a signal sent from a signal source and provided on the substrate, wherein said at least one of the fed radiation electrode includes a fed end section side which receives a signal from the signal source and is arranged opposite another end side defining an open end, with a gap provided therebetween; and at least one non-fed radiation electrode that is provided on the substrate and electromagnetically coupled with said at least one fed radiation electrode to generate a double-resonant state.

2. A surface mount type antenna according to claim 1, wherein the at least one non-fed radiation electrode has a loop shape and includes one ground end connected to ground and an open end arranged opposite to the ground end with a gap provided therebetween.

3. A surface mount type antenna according to claim 1, wherein the at least one fed radiation electrode and the at least one non-fed radiation electrode are arranged to perform a basic-mode resonant operation and a high-order-mode resonant operation having a higher resonant frequency than in the basic mode, and the distance between the open end of the at least one fed radiation electrode or the at least one non-fed radiation electrode and a portion opposite the open end through one of said gaps is changed to adjust the capacitance of a capacitor defined between the open end and the portion opposite to the open end to that corresponding to a specified high-order-mode resonant frequency.

4. A surface mount type antenna according to claim 1, wherein each of the at least one non-fed radiation electrode and the at least one fed radiation electrode has a loop shape, the loop shape of the at least one fed radiation electrode or the at least one non-fed radiation electrode is provided by a slit for a plane-shaped pattern, and the slit is folded once or more times.

5. A surface mount type antenna according to claim 1, wherein the substrate is a dielectric substrate, and the dielectric substrate defines a coupling-amount adjusting element for adjusting the amount of coupling between the at least one fed radiation electrode and the at least one non-fed radiation electrode by the dielectric constant of the substrate.

6. A surface mount type antenna according to claim 1, wherein the at least one fed radiation electrode and the at least one non-fed radiation electrode are arranged to perform a basic-mode resonant operation and a high-order-mode resonant operation having a higher resonant frequency than in the basic mode, the substrate is a dielectric substrate, and the dielectric substrate defines a open-end-capacitor adjusting element for adjusting the capacitance of a capacitor defined between the open end of the at least one loop-shaped fed radiation electrode or the at least one loop-shaped non-fed radiation electrode and a portion opposite the open end by the dielectric constant of the substrate to adjust the high-order-mode resonant frequency.

7. A surface mount type antenna according to claim 1, wherein at least one of a capacity-loaded electrode arranged through a gap adjacent to the at least one fed radiation electrode and having a capacitor defined between itself and the at least one fed radiation electrode and a capacity-loaded electrode arranged through a gap adjacent to the at least one non-fed radiation electrode and having a capacitor defined between itself and the at least one non-fed radiation electrode is provided, and at least one of the capacity-loaded electrodes is electrically connected to the ground.

8. A radio transmitter and receiver comprising surface mount type antenna described in claim 1.

9. A surface mount type antenna comprising:

a substrate;

a signal source;

at least one fed radiation electrode provided on said substrate and arranged to receive a signal sent from the signal source, said at least one of the fed radiation electrode includes a fed end section side which receives a signal from the signal source and an opposite open end with a gap provided therebetween; and at least one non-fed radiation electrode that is provided on the substrate and electromagnetically coupled with said at least one fed radiation electrode to generate a double-resonant state.

10. A surface mount type antenna according to claim 9, wherein the at least one non-fed radiation electrode has a loop shape and includes a ground end connected to a ground and an open end and an open end arranged opposite the ground end with a gap provided therebetween.

11. A surface mount type antenna according to claim 9, wherein the fed radiation electrode and the non-fed radiation electrode are arranged to perform a basic-mode resonant operation and a high-order-mode resonant operation having a higher resonant frequency than in the basic mode, and the distance between the open end of the loop-shaped fed radiation electrode or the loop-shaped non-fed radiation electrode and a portion opposite the open end through one of said gaps is changed to adjust the capacitance of a capacitor defined between the open end and the portion opposite the open end to that corresponding to a specified high-order-mode resonant frequency.

12. A surface mount type antenna according to claim 9, wherein each of the at least one fed radiation electrode and the at least one non-fed radiation electrode have a loop shape, and the loop shape of the at least one fed radiation electrode or the at least one non-fed radiation electrode is provided by a slit for a plane-shaped pattern, and the slit is folded once or more times.

13. A surface mount type antenna according to claim 9, wherein that the substrate is a dielectric substrate, and the dielectric substrate defines a coupling-amount adjusting element for adjusting the amount of coupling between the at least one fed radiation electrode and the at least one non-fed radiation electrode by the dielectric constant of the substrate.

14. A surface mount type antenna according to claim 9, wherein the at least one fed radiation electrode and the at least one non-fed radiation electrode are arranged to perform a basic-mode resonant operation and a high-order-mode resonant operation having a higher resonant frequency than in the basic mode, the substrate is a dielectric substrate, and the dielectric substrate defines a open-end-capacitor adjusting element for adjusting the capacitance of a capacitor defined between the open end of the at least one loop-shaped fed radiation electrode or the at least one loop-shaped non-fed radiation electrode and a portion opposite the open end by the dielectric constant of the substrate to adjust the high-order-mode resonant frequency.

15. A surface mount type antenna according to claim 9, wherein at least one of a capacity-loaded electrode arranged through a gap adjacent to the at least one fed radiation electrode and having a capacitor defined between itself and the at least one fed radiation electrode and a capacity-loaded electrode arranged through a gap adjacent to the at least one non-fed radiation electrode and having a capacitor defined between itself and the at least one non-fed radiation electrode is provided, and at least one of the capacity-loaded electrodes is electrically connected to the ground.

16. A surface mount type antenna according to claim 9, wherein said at least one fed radiation electrode comprises a plurality of fed radiation electrodes.

17. A surface mount type antenna according to claim 9, wherein said at least one non-fed radiation electrode comprises a plurality of non-fed radiation electrodes.

18. A radio transmitter and receiver comprising a surface mount type antenna described in claim 9.

* * * * *